US009022122B2

(12) United States Patent
Tran

(10) Patent No.: US 9,022,122 B2
(45) Date of Patent: May 5, 2015

(54) HIGH-PRESSURE CAP EQUALIZATION VALVE

(75) Inventor: Nghia T. Tran, Houston, TX (US)

(73) Assignee: OneSubsea IP UK Limited, London (GB)

( * ) Notice: Subject to any disclaimer, the term of this patent is extended or adjusted under 35 U.S.C. 154(b) by 307 days.

(21) Appl. No.: 13/408,948

(22) Filed: Feb. 29, 2012

(65) Prior Publication Data

US 2013/0220628 A1 Aug. 29, 2013

(51) Int. Cl.

| | |
|---|---|
| ***E21B 29/12*** | (2006.01) |
| ***E21B 33/035*** | (2006.01) |
| ***E21B 33/037*** | (2006.01) |
| ***E21B 33/04*** | (2006.01) |
| ***E21B 34/10*** | (2006.01) |
| ***E21B 34/04*** | (2006.01) |

(52) U.S. Cl.
CPC ..... *E21B 33/037* (2013.01); *E21B 33/04* (2013.01); *E21B 34/101* (2013.01); *E21B 33/035* (2013.01); *E21B 34/04* (2013.01)

(58) Field of Classification Search
CPC ..... E21B 33/035; E21B 33/037; E21B 34/04
USPC ..... 166/339–341, 343, 348, 351, 368, 381, 166/93.1, 94.1, 95.1, 97.1, 75.13; 138/89
See application file for complete search history.

(56) References Cited

U.S. PATENT DOCUMENTS

| | | | | |
|---|---|---|---|---|
| 3,971,171 | A * | 7/1976 | Wood | 52/19 |
| 6,736,161 | B2 | 5/2004 | Kjellander et al. | |
| 6,810,954 | B2 * | 11/2004 | Garrett et al. | 166/77.51 |
| 7,637,325 | B2 * | 12/2009 | Goonetilleke et al. | 166/368 |
| 7,677,319 | B2 | 3/2010 | Baskett | |
| 2003/0111227 | A1 | 6/2003 | Neugebauer | |
| 2004/0216885 | A1 * | 11/2004 | Bartlett | 166/343 |
| 2008/0087436 | A1 * | 4/2008 | Baskett | 166/344 |
| 2008/0190621 | A1 * | 8/2008 | Huang et al. | 166/339 |
| 2009/0266551 | A1 * | 10/2009 | Cuiper et al. | 166/338 |
| 2011/0048726 | A1 | 3/2011 | Aarnes et al. | |
| 2012/0168173 | A1 * | 7/2012 | Urquhart et al. | 166/368 |

OTHER PUBLICATIONS

International Search Report and Written Opinion of the International Searching Authority dated May 25, 2013 for related PCT Application No. PCT/US2013/025842 filed Feb. 13, 2013.

* cited by examiner

*Primary Examiner* — James G Sayre
(74) *Attorney, Agent, or Firm* — Chamberlain Hrdlicka

(57) ABSTRACT

A cap for protecting a sealing surface of a hub of a subsea device includes an equalization valve and a fluid conduit. The equalization valve includes a valve body having a pressure equalization conduit, a sleeve disposed about the valve body and having a port allowing fluid communication across the sleeve, and a valve spring configured to bias the sleeve to a closed position. The sleeve is configured to move to an open position in response to a force that depresses the sleeve and causes the valve spring to compress and the port is fluidly isolated from the pressure equalization conduit in the closed position and is in fluid communication with the pressure equalization conduit in the open position. In the open position, an interior environment of the subsea device is in fluid communication with the environment outside the cap through the equalization valve.

19 Claims, 8 Drawing Sheets

HIGH-PRESSURE CAP EQUALIZATION VALVE

BACKGROUND

In subsea hydrocarbon drilling operations, a Christmas tree may be installed on a wellhead to control the flow of the well. The Christmas tree contains various hub terminations, which are subsequently used to couple the Christmas tree to various manifolds, connectors, jumpers and the like. The hubs include sealing surfaces that need to be protected from the subsea environment prior to the hubs being connected to other manifolds, connector, jumpers and the like. A high-pressure cap is placed onto the hub prior to lowering the Christmas tree subsea to protect the sealing surfaces from the damaging effects that the subsea environment may cause. The use of a high-pressure cap effectively seals the interior of the Christmas tree at atmospheric pressure or the pressure at the surface. The water pressure outside the Christmas tree increases greatly as depth increases when the Christmas tree is lowered subsea. As a result, the water pressure greatly exceeds the pressure inside the Christmas tree when the Christmas tree is, for example, installed at the wellhead on the seabed.

Once the Christmas tree is installed subsea, a running tool is used to remove the high-pressure cap from the hub to allow the hub to be coupled to another manifold or the like. However, because of the large pressure differential across the high-pressure cap, the pressure across the cap must be equalized prior to removing the cap. The high-pressure cap is provided with a valve that, when opened, equalizes the pressure across the cap. In some cases, the valve is a hydraulically-actuated valve and the running tool comprises hydraulic lines that operate the valve. However, such hydraulically-actuated valves are complex and have a large form factor, making it difficult to maneuver the running tool onto the high-pressure cap or to place other manifolds or connectors in close proximity to the hub. Additionally, the height of the high-pressure cap (or distance the cap extends from the hub when installed) may be increased by such valves, requiring connectors to be placed a greater distance away from the hub, which in turn complicates subsequent coupling to the hub. In particular, "wet parking," which is one advantage of a horizontal coupling system, may be further complicated. Further, hydraulically-actuated valves may need to displace a certain volume of seawater to move from a closed position to an open position, requiring a large amount of force and further increasing the form factor of the valve and associated actuation mechanisms.

Additionally, if a component of the Christmas tree (e.g., valves) malfunctions, the high-pressure cap is the last barrier to the subsea environment. In such a case, the high-pressure cap must contain and relieve pressure from the interior of the Christmas tree. This requires a valve having a large form factor, which includes the disadvantages mentioned above.

DESCRIPTION OF THE DRAWINGS

For a more detailed description of the embodiments, reference will now be made to the following accompanying drawings.

DESCRIPTION OF THE EMBODIMENTS

Figure 1A:
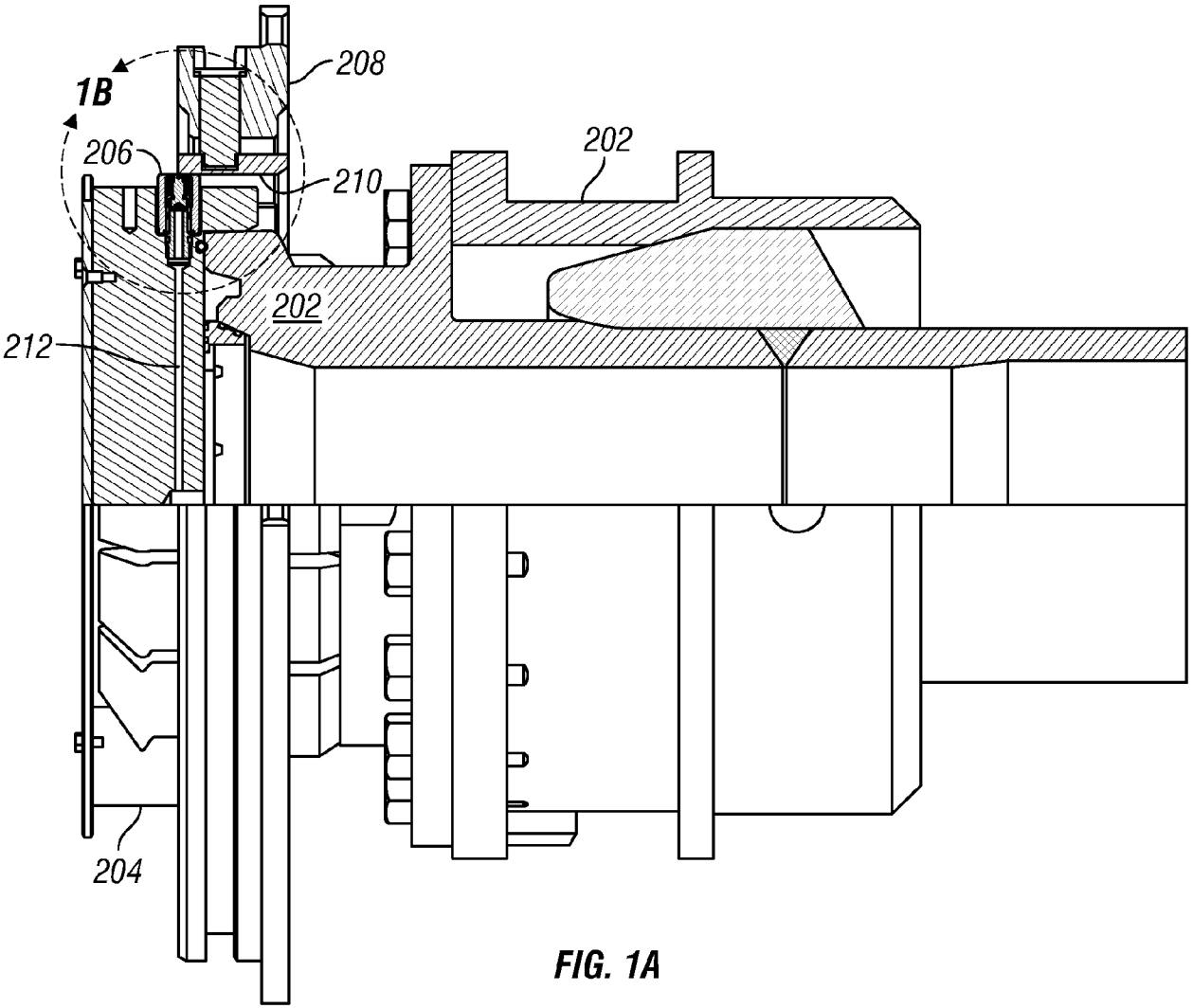
FIG. 1A shows a perspective view of a hub termination and high-pressure cap comprising an equalization valve in accordance with various embodiments.

In the drawings and description that follows, like parts are marked throughout the specification and drawings with the same reference numerals. The drawing figures are not necessarily to scale. Certain features of the invention may be shown exaggerated in scale or in somewhat schematic form and some details of conventional elements may not be shown in the interest of clarity and conciseness. The invention is subject to embodiments of different forms. Some specific embodiments are described in detail and are shown in the drawings, with the understanding that the disclosure is to be considered an exemplification of the principles of the invention, and is not intended to limit the invention to the illustrated and described embodiments. The different teachings of the embodiments discussed below may be employed separately or in any suitable combination to produce desired results. The terms connect, engage, couple, attach, or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

In accordance with various embodiments, a high-pressure cap is installed on a hub termination of a Christmas tree, a manifold, a connector, or the like (generally, a "subsea device") to protect sealing surfaces of the hub from exposure to seawater. The high-pressure cap creates a pressure-tight seal with the hub to prevent degradation of the sealing surface of the hub and the interior surfaces of the subsea device. The subsea device is subsequently lowered subsea, causing a pressure differential to build across the high-pressure cap. In some cases, the pressure differential may exceed 3000 psi at the seafloor, which effectively locks the high-pressure cap to the hub.

The subsea device is installed subsea, or positioned such that the hub(s) may be subsequently coupled to a connector, jumper, or the like. A remotely-operated vehicle (ROV) may be responsible for positioning a connector in proximity to the hub to which it will be coupled. Ideally, the distance between the connector and the hub is minimized while still enabling the removal of the high-pressure cap prior to completing the connection between the hub and the connector. As explained above, the pressure differential across the high-pressure cap may be very large, requiring the differential to be reduced or eliminated prior to removing the high-pressure cap from the hub. As used herein, the terms inner or interior refer to the space inside of a subsea device, which is isolated from the outer or exterior environment by the high-pressure cap. Thus, the inner portion of the high-pressure cap is exposed to the inside of the subsea device and the outer portion of the high-pressure cap is exposed to the external environment (e.g., seawater).

Referring now to FIG. 1A, a high-pressure cap 204 is shown coupled to a hub 202 (e.g., a termination of a Christmas tree or manifold) having a bore. The high-pressure cap 204 protects a sealing surface of the hub 202, for example when the Christmas tree or manifold is being lowered subsea. The high-pressure cap 204 comprises a pressure-seal portion (not shown) that enables a pressure differential to form across the high-pressure cap 204 when the high-pressure cap 204 is coupled to a hub 202, as shown in FIG. 1A. The high-pressure cap 204 includes an equalization valve 206, which will be described in further detail below. A running tool 208 is shown in an equalization position in which a surface 210 of the running tool 208 depresses a sleeve of the equalization valve 206. The running tool 208 may be positioned and operated by a ROV. A conduit 212 in the high-pressure cap 204 enables a fluid connection to be formed between the bore of the hub 202 and the exterior of the hub 202 when the sleeve of the equalization valve 206 is depressed, allowing pressure to equalize across the high-pressure cap 204.

Figure 2A:
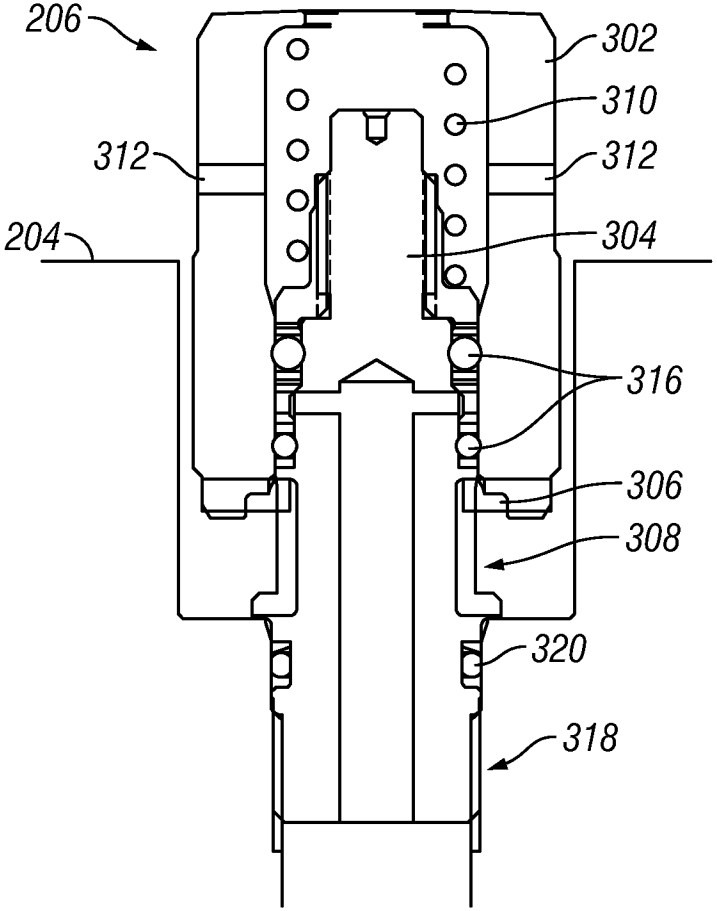
FIG. 2A shows a perspective view of an equalization valve in a closed position in accordance with various embodiments.

Turning now to FIG. 2A, the equalization valve 206 is shown in further detail. The equalization valve 206 includes a sleeve 302 coupled to a valve body 304. The sleeve 302 includes one or more retention pins 306 that engage a pin recess 308 of the valve body 304. The interaction between the retention pins 306 and the pin recess 308 limit the longitudinal movement of the sleeve 302 relative to the valve body 304. Alternately, the valve body 304 may comprise a retention pin that engages a pin recess of the sleeve 302.

The equalization valve 206 also includes a valve spring 310 that biases the sleeve 302 into a closed position. As shown, the valve spring 310 is in a relaxed position. As explained above, the interaction between the retention pins 306 and the pin recess 308 prevents the valve spring 310 from causing excessive movement or separation between the sleeve 302 and the valve body 304. In the closed position, ports 312 in the sleeve 302 are not in fluid communication with a pressure equalization conduit 314 in the valve body 304. As shown, o-rings 316 provide fluid isolation between the pressure equalization conduit 314 and the ports 312.

The equalization valve 206 is shown coupled to the high-pressure cap 204 through a connection 318. The connection 318 may be, for example, a threaded connection. An o-ring 320 prevents fluid communication between the bore of the hub 202 (e.g., through the conduit 212 of the high-pressure cap 204 shown in FIG. 1A) and the exterior of the equalization valve 206 when the equalization valve 206 is in the closed position.

Figure 2B:
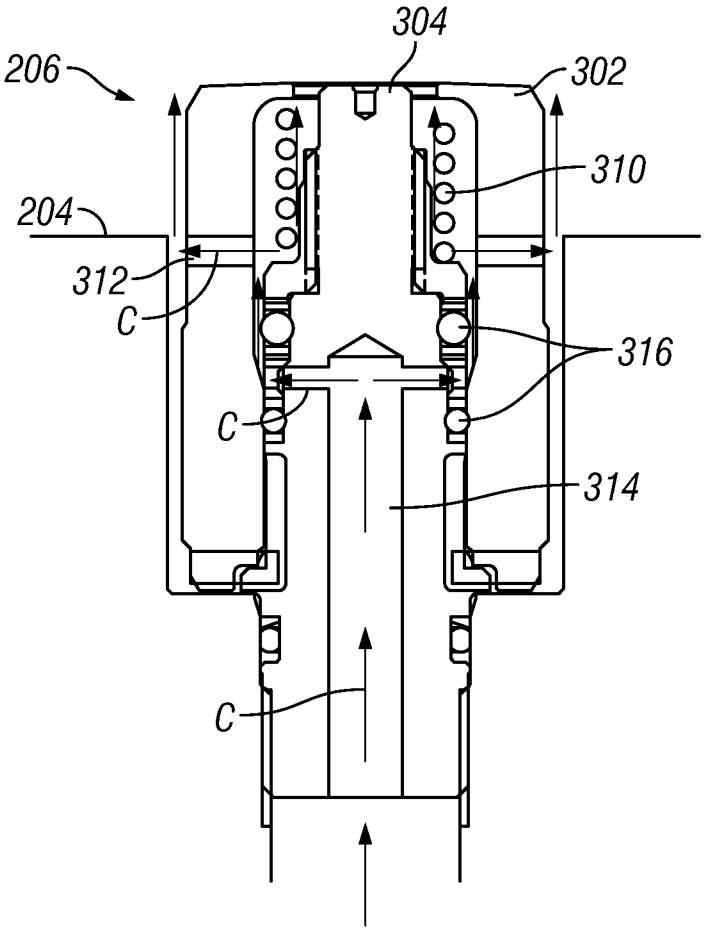
FIG. 2B shows a perspective view of an equalization valve in an open position in accordance with various embodiments.

FIG. 2B shows the equalization valve 206 in further detail and in an open position. In the open position, the sleeve 302 is depressed toward the valve body 304, causing the valve spring 310 to be in a compressed position. The sleeve 302 is exposed to the exterior environment such that no fluid is displaced when the sleeve 302 moves from the closed position to the open position, and vice versa. Thus, the valve spring 310 need not be sized to overcome any pressure differential acting on the sleeve 302, enabling the sleeve 302 to be depressed with less force. In some embodiments, the valve spring 310 may have a spring constant between 27 pounds/inch (e.g., when uncompressed) and 53 pounds/inch (e.g., when compressed).

In accordance with various embodiments, the location of the ports 312 is selected such that the ports 312 are in fluid communication with the pressure equalization conduit 314 when the equalization valve 206 is in the open position. An exemplary fluid path C shows the flow of fluid through the pressure equalization conduit 314 to the exterior of the equalization valve 206. As shown in FIG. 1A, the fluid flow may be from or to the bore of the hub 202 though the conduit 212 in the high-pressure cap 204. Although shown as fluid exiting the equalization valve 206, one skilled in the art appreciates that the flow may be bi-directional in the case of pressure equalizing across the high-pressure cap 202 (e.g., air may flow out from the bore along fluid path C and seawater may flow into the bore along fluid path C).

Figure 1B:
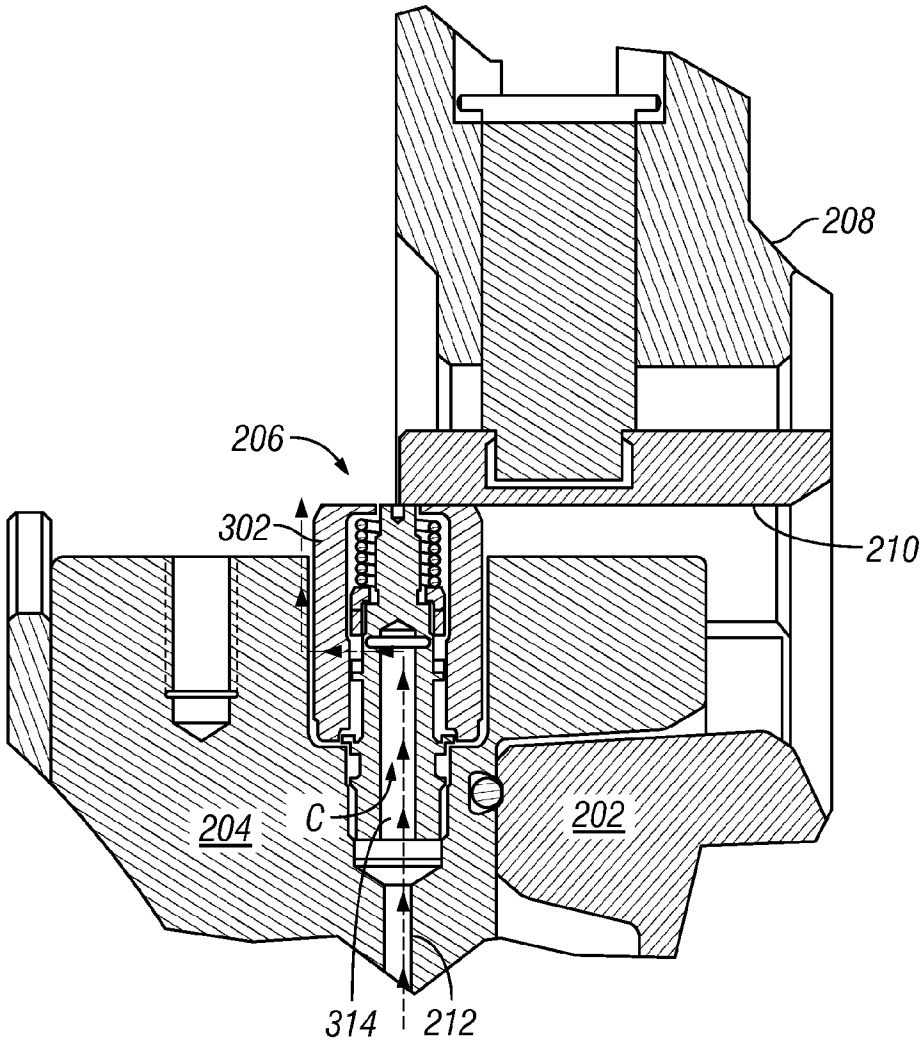
FIG. 1B shows a close-up view of the high-pressure cap and equalization valve of FIG. 1A.

Turning now to FIG. 1B, region 1B identified in FIG. 1A is shown in further detail. The surface 210 of the running tool 208 depresses the sleeve 302 of the equalization valve 206, causing the equalization valve 206 to be in the open position. This enables fluid flow across the equalization valve 206 through the pressure equalization conduit 314 and the ports (not shown) of the sleeve 302. The conduit 212 in the high-pressure cap 204, which is fluidly coupled to the pressure equalization conduit 314 and the inside face of the high-pressure cap 204, enables fluid communication between the bore of the hub 202 and the exterior environment (e.g., seawater). Thus, when the running tool 208 is in the equalization position as shown, pressure is equalized across the high-pressure cap 204.

Figure 3A:
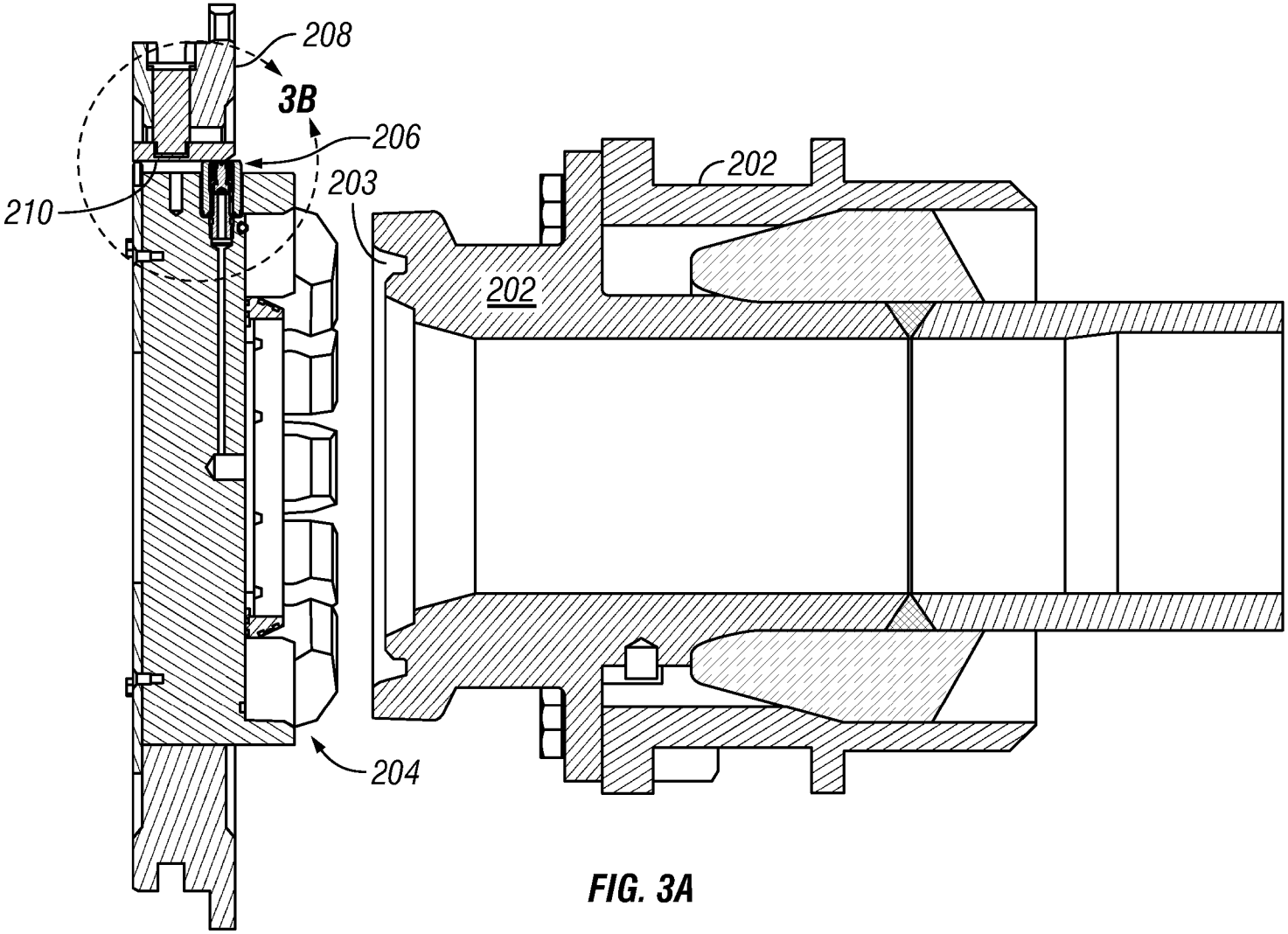
FIG. 3A shows a perspective view of the hub termination of FIG. 1A with the high-pressure cap comprising an equalization valve removed from the hub in accordance with various embodiments.

FIG. 3A shows the running tool 208 in a removal position with the high-pressure cap 204 removed from the hub 202. Alternately, the view of FIG. 3A may be prior to installing the high-pressure cap 204 on the hub 202. The high-pressure cap 204 may be removed from the hub 202 when the pressure differential across the high-pressure cap 204 has been equalized, or is low enough that the differential is overcome by the running tool 208. A ROV may monitor the pressure differential across the high-pressure cap 204 when the running tool 208 is in the equalization position and, when the differential is within an acceptable range, move the running tool 208 to the removal position to remove the high-pressure cap 204 from the hub 202. An acceptable range for the pressure differential may be determined by, for example, the pulling force of the ROV. In some embodiments, the running tool 208 unlocks the high-pressure cap 204 from the hub 202 prior to removing the high-pressure cap 204. A sealing surface 203 of the hub 202 is exposed when the high-pressure cap 204 is removed, enabling the hub 202 to be subsequently coupled to another manifold, connector, jumper or the like.

As shown in the removal position, the surface 210 of the running tool 208 is positioned such that the equalization valve 206 is in the closed position. Alternately, however, the equalization valve 206 may be held in the open position by the running tool 208 because both sides of the high-pressure cap 204 are now exposed to the same environment and pressure containment is not as important. Alternatively, the surface 210 of the running tool 208 may be adjustable when the running tool is in the removal position to cause the equalization valve 206 to be in either the open or closed position.

Figure 3B:
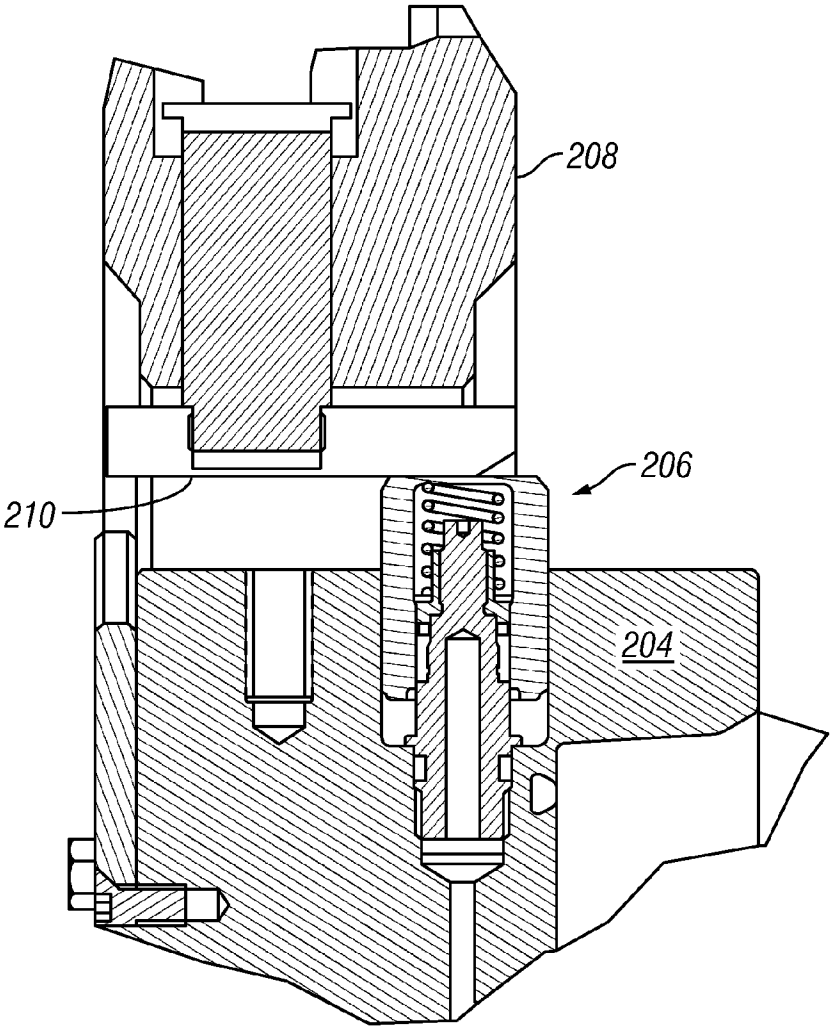
FIG. 3B shows a close-up view of the high-pressure cap and equalization valve of FIG. 3A.

Turning now to FIG. 3B, region 3*b* identified in FIG. 3A is shown in further detail. The surface 210 of the running tool 208 is positioned to allow the valve spring 310 to relax, causing the equalization valve 206 to be in the closed position. However, in some embodiments, when the running tool 208 is coupled to the high-pressure cap 204, a latch of the running tool (not shown) locks the high-pressure cap 204 to the running tool 208 and depresses the equalization valve 206 to be in the open position. As explained above, when the high-pressure cap 204 is removed or in the process of being removed from the hub 202, it is not essential that the equalization valve 206 be in the closed position, since the high-pressure cap 204 is no longer being used to contain a pressure.

In accordance with various embodiments, the valve spring 310 need not overcome the pressure differential between the interior and the exterior of the equalization valve 206 (e.g., as would be the case with a poppet-type valve) when the equalization valve 206 is in the closed position, enabling the valve spring 310 to be advantageously reduced in both physical size and spring rate. Additionally, in moving from the closed position to the open position, the sleeve 302 does not displace any fluid and thus requires only enough force to cause the valve spring 310 to compress to move to the open position.

In contrast to prior pressure equalization solutions, the equalization valve 206 maintains a small form factor and requires a greatly reduced amount of force to open the equalization valve 206 (i.e., to actuate the sleeve 302 and compress the valve spring 310). This enables the equalization valve 206 to be positioned along the circumference of the high-pressure cap 204 (e.g., as shown FIG. 1A) rather than on its outer face, which reduces the overall height of the high-pressure cap 204. Minimizing the overall height of the high-pressure cap 204 enables connectors to be positioned in closer proximity to the hub 202 prior to being coupled to the hub 202 and facilitates ease of maneuvering the running tool 208 onto or around the high-pressure cap 204. Alternately, however, the equalization valve 206 may be positioned on the outer face of the high-pressure cap 204 while still allowing a reduction in overall height of the high-pressure cap 204 as compared to prior art valves.

Figure 4A:
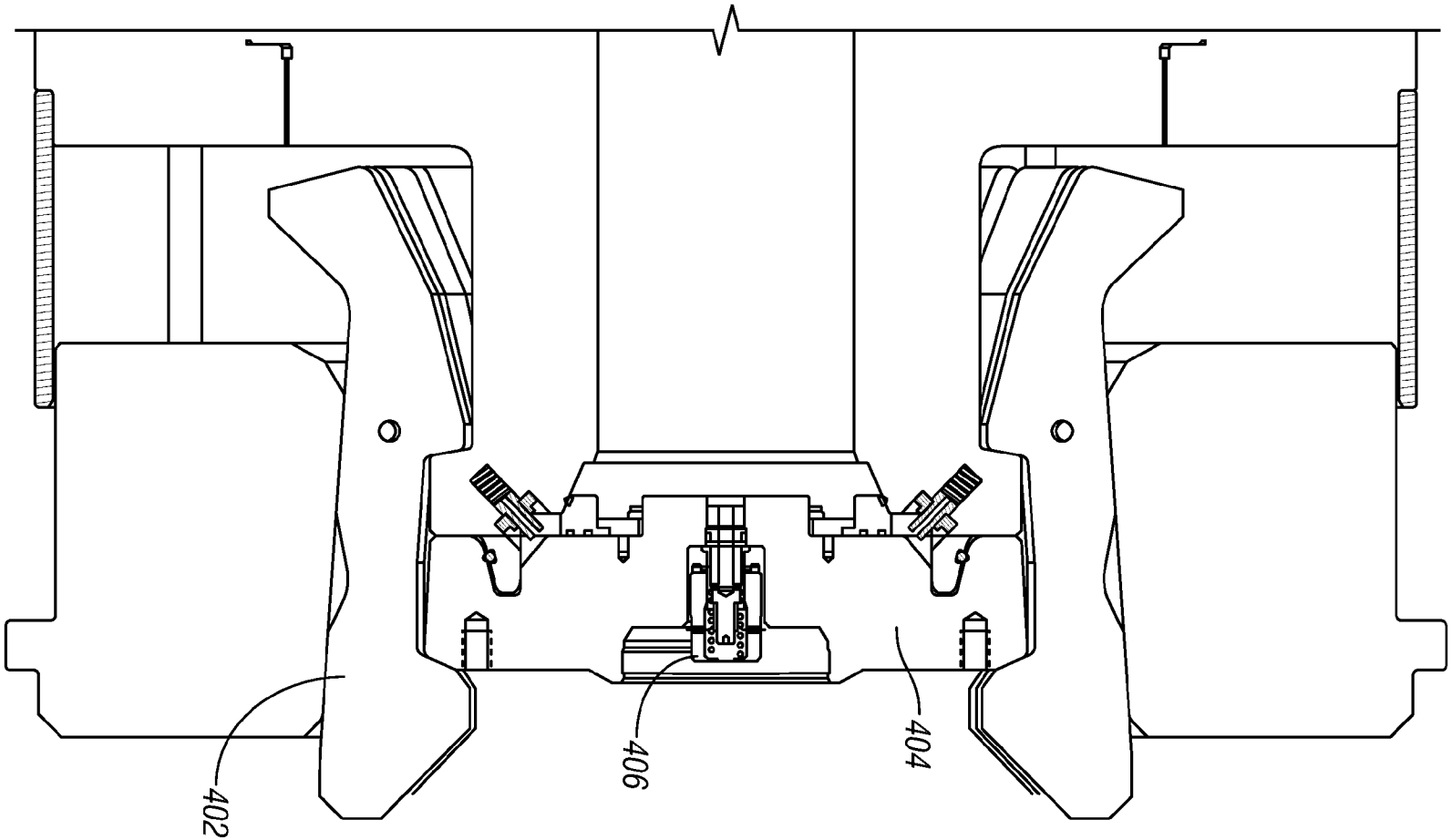
FIG. 4A shows a perspective view of a connector termination and high-pressure cap comprising an equalization valve in accordance with various embodiments.

FIG. 4A, shows a high-pressure cap 404 is shown coupled to a connector 402 (e.g., a jumper connector for connection to a termination of a Christmas tree or manifold) having a bore. The high-pressure cap 404 protects a sealing surface of the connector 402, for example when the connector 402 is being lowered subsea. The high-pressure cap 404 comprises a pressure-seal portion (not shown) that enables a pressure differential to form across the high-pressure cap 404 when the high-pressure cap 404 is coupled to the connector 402. The high-pressure cap 404 includes an equalization valve 406 in accordance with various embodiments.

Figure 4B:
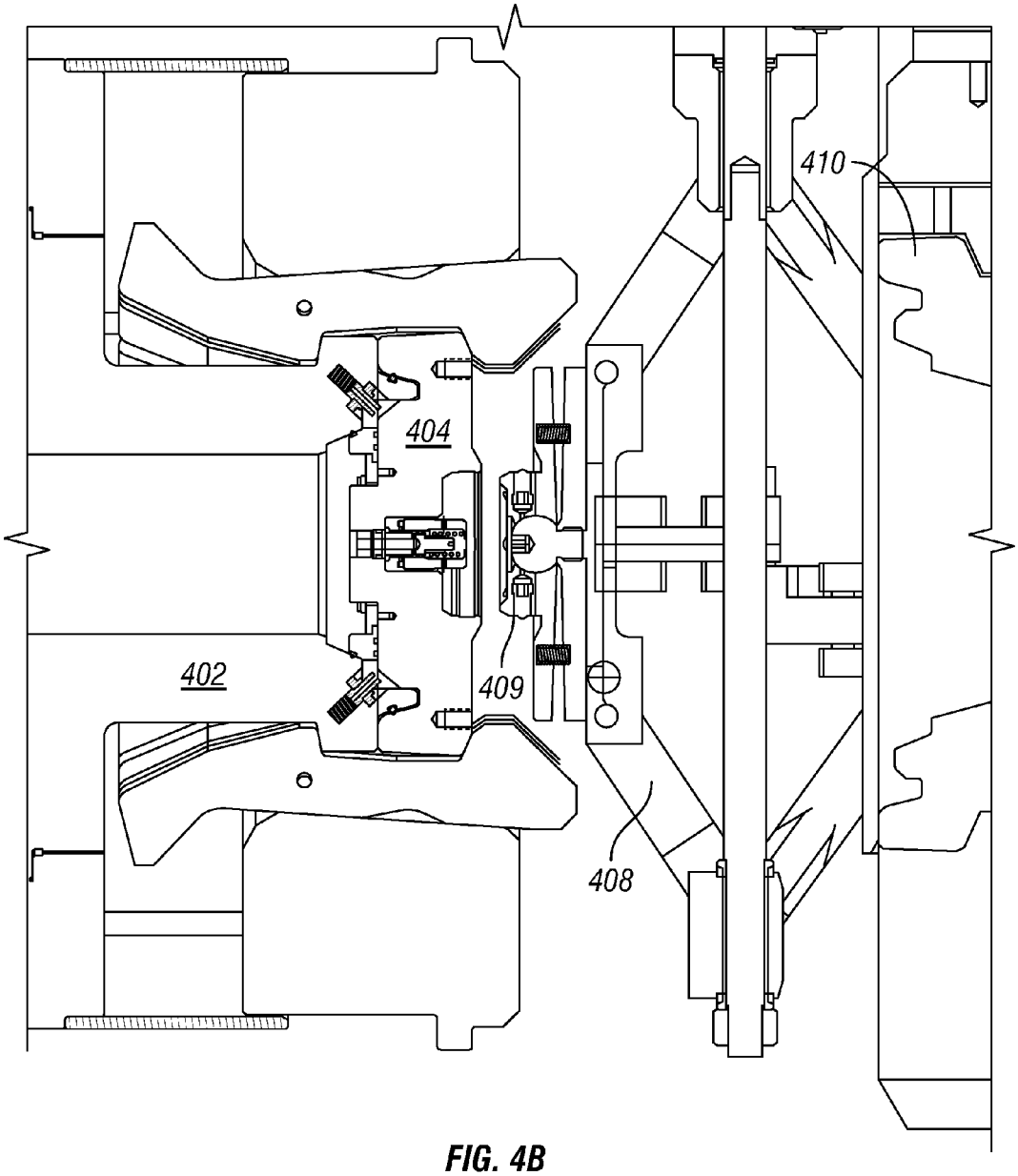
FIG. 4B shows a perspective view of a connector cap tool in proximity to the high-pressure cap of FIG. 4A in accordance with various embodiments.
Figure 4C:
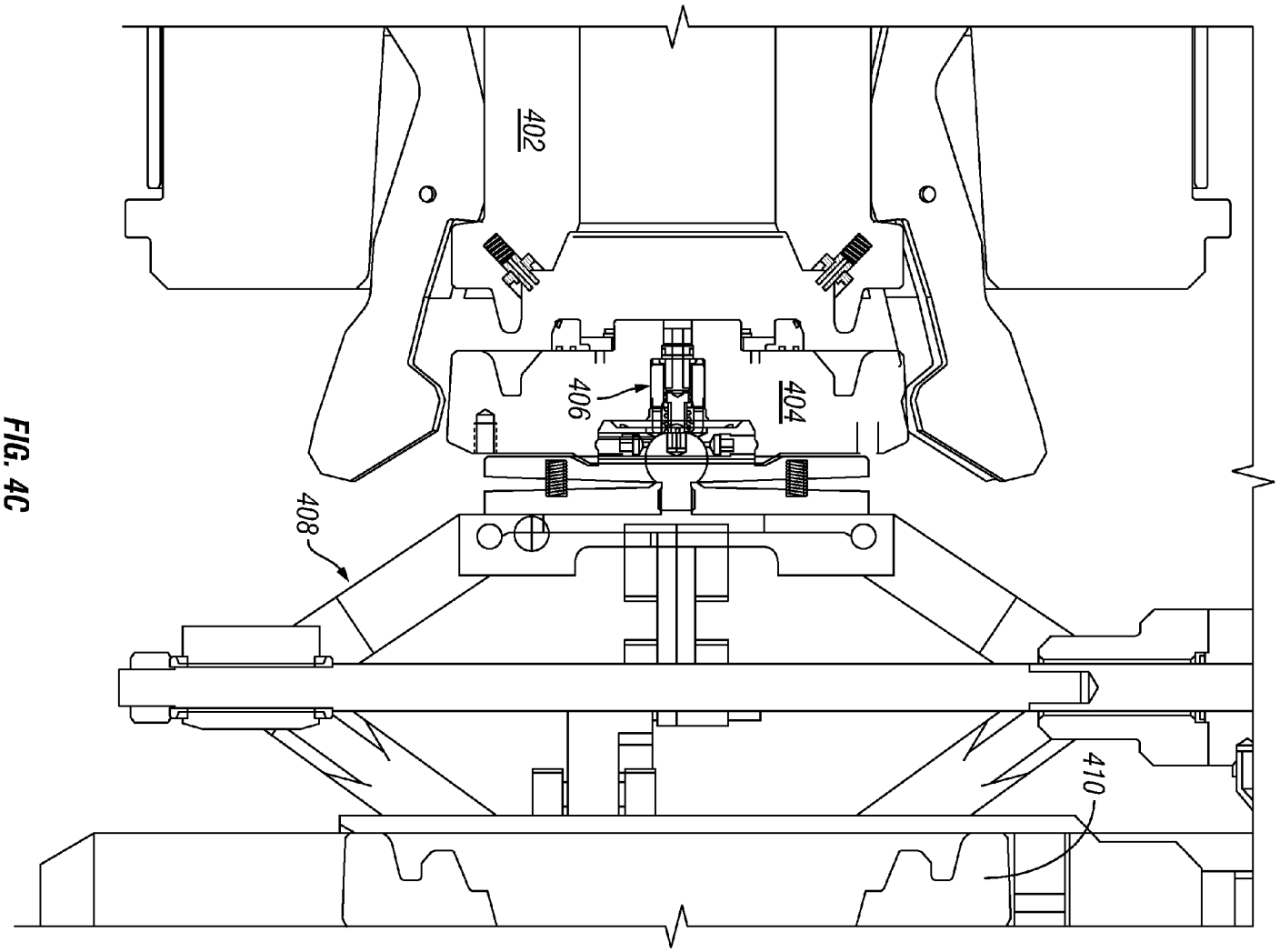
FIG. 4C shows a perspective view of the connector cap tool of FIG. 4B engaging the high-pressure cap for installation or removal of the high-pressure cap from the connector in accordance with various embodiments.

Turning now to FIG. 4B, a connector cap tool 408 (which may be similar in function to the running tool 208) is shown prior to engaging the high-pressure cap 404 for removal from the connector 402 (or, alternately, after installing the high-pressure cap 404 on the connector 402). The connector cap tool 408 may be coupled to a hub 410. The connector cap tool 408 also comprises a protruding member 409 to engage the high-pressure cap 404 and depress the equalization valve to fluidly couple the interior and exterior of the connector 402. FIG. 4C shows the connector cap tool 408 engaging the high-pressure cap 404 and depressing the equalization valve 406. In particular, the protruding member 409 is engaging the high-pressure cap 404 and depressing the equalization valve 406. When the pressure is equalized across the high-pressure cap 404, the high-pressure cap 404 may be removed from the connector 402 and the connector 402 may be coupled to, for example, the hub 410.

While specific embodiments have been shown and described, modifications can be made by one skilled in the art without departing from the spirit or teaching of this invention. The embodiments as described are exemplary only and are not limiting. Many variations and modifications are possible and are within the scope of the invention. For example, this could apply to any manifold, connector or hub termination having connection or sealing surfaces that require protection during subsea lowering and installation, particularly where the pressure differential across the protection cap is high. Accordingly, the scope of protection is not limited to the embodiments described, but is only limited by the claims that follow, the scope of which shall include all equivalents of the subject matter of the claims.

What is claimed is:

1. A cap for protecting a sealing surface of a hub of a subsea device with an interior environment, comprising:
- a pressure-seal portion configured to form a pressure seal between an inner face of the cap and the hub;
- an equalization valve, comprising:
  - a valve body comprising a pressure equalization conduit;
  - a sleeve disposed about the valve body and comprising a port allowing fluid communication across the sleeve, the sleeve being exposed to the environment outside the cap;
  - a valve spring configured to bias the sleeve to a closed position;
  - wherein the sleeve is configured to move to an open position in response to a force that depresses the sleeve and causes the valve spring to compress;
  - wherein the port is fluidly isolated from the pressure equalization conduit in the closed position and is in fluid communication with the pressure equalization conduit in the open position; and
- a fluid conduit that couples the inner face of the cap and the pressure equalization conduit such that, in the open position, the interior environment of the subsea device is in fluid communication with the environment outside the cap through the equalization valve.

2. The cap of claim 1 wherein the equalization valve is positioned along the circumference of the cap.

3. The cap of claim 1 wherein the equalization valve is positioned on the outer face of the cap.

4. The cap of claim 1 wherein when the sleeve moves to the open position, pressure is equalized across the cap through a fluid path comprising the port, the pressure equalization conduit, and the fluid conduit.

5. The cap of claim 1 wherein the volume of fluid displaced in the exterior environment does not change when the sleeve moves from the closed position to the open position.

6. The cap of claim 1 wherein the valve spring comprises a spring constant less than 53 pounds/inch.

7. The cap of claim 1 further comprising a running tool configured to couple to the cap, wherein the running tool is configured to depress the sleeve of the equalization valve and remove the cap from the hub.

8. The cap of claim 7 wherein the running tool is configured to be operated by a remotely-operated vehicle.

9. A subsea hydrocarbon production system, comprising:
- a Christmas tree to control the flow of hydrocarbons from a wellhead, comprising a hub;
- a cap to protect a sealing surface of the hub, comprising:
  - a pressure-seal portion configured to form a pressure seal between an inner face of the cap and the hub;
  - an equalization valve, comprising:
    - a valve body comprising a pressure equalization conduit;
    - a sleeve disposed about the valve body and comprising a port allowing fluid communication across the sleeve, the sleeve being exposed to the environment outside the cap;

a valve spring configured to bias the sleeve to a closed position;

wherein the sleeve is configured to move to an open position in response to a force that depresses the sleeve and causes the valve spring to compress;

wherein the port is fluidly isolated from the pressure equalization conduit in the closed position and is in fluid communication with the pressure equalization conduit in the open position; and a fluid conduit that couples the inner face of the cap and the pressure equalization conduit such that, in the open position, an interior environment of the Christmas tree is in fluid communication with the environment outside the cap through the equalization valve.

10. A method of protecting a sealing surface of a hub of a subsea device and isolating an interior environment of the subsea device from an exterior environment, comprising:

installing a cap on the hub, thereby creating a pressure seal between the cap and the hub, wherein the cap is exposed to the exterior environment;

lowering the subsea device into a fluid, the fluid comprising the exterior environment, wherein the densities of the exterior environment and interior environment are different such that a pressure differential is created across the cap when lowering the subsea device;

depressing a sleeve of an equalization valve to an open position creating a fluid path between the exterior environment and the interior environment, wherein the sleeve is biased to a closed position; and removing the cap from the hub.

11. The method of claim 10 wherein depressing the sleeve to the open position causes pressure to be equalized across the cap through the fluid path.

12. The method of claim 10 wherein the sleeve is biased to the closed position by a valve spring.

13. The method of claim 12 wherein the valve spring comprises a spring constant less than 53 pounds/inch.

14. The method of claim 10 wherein a running tool depresses the sleeve of the equalization valve and removes the cap from the hub.

15. The method of claim 14 wherein a remotely-operated vehicle operates the running tool.

16. The method of claim 10 further comprising monitoring the pressure differential across the cap and, when the pressure differential is within an acceptable range, removing the cap from the hub.

17. The method of claim 16 wherein an ROV monitors the pressure differential across the cap.

18. The method of claim 10 further comprising unlocking the cap from the hub prior to removing the cap from the hub.

19. The method of claim 10 further comprising coupling another subsea device to the hub after removing the cap from the hub.

* * * * *